US006708344B2

(12) United States Patent
Friedman

(10) Patent No.: US 6,708,344 B2
(45) Date of Patent: Mar. 23, 2004

(54) KNITTED SHIRT COLLAR WITH PLASTIC STAYS

(76) Inventor: Marc Friedman, 14100 NW. 58th Ct., Miami Lakes, FL (US) 33014

( * ) Notice: Subject to any disclaimer, the term of this patent is extended or adjusted under 35 U.S.C. 154(b) by 0 days.

(21) Appl. No.: 10/058,204

(22) Filed: Jan. 29, 2002

(65) Prior Publication Data

US 2003/0140393 A1 Jul. 31, 2003

(51) Int. Cl.[7] ..... A41B 3/00
(52) U.S. Cl. ..... 2/132
(58) Field of Search ..... 2/129, 255, 256, 2/137, 130–132, 175.4, 195.5, 116; 223/52, 52.1, 84; 156/160, 293, 494; 66/170, 171, 172 R

(56) References Cited

U.S. PATENT DOCUMENTS 1,283,698 A * 11/1918 Doty ..... 2/132
1,845,884 A * 2/1932 Marinsky ..... 2/116
3,030,630 A * 4/1962 Katterman ..... 2/116
3,286,278 A 11/1966 O'Connor
3,832,737 A 9/1974 Podosky
3,909,850 A * 10/1975 Scott ..... 2/132
4,038,840 A 8/1977 Castello
4,169,753 A * 10/1979 Wendell ..... 156/160
4,286,337 A 9/1981 Malouf, Jr.
6,167,732 B1 1/2001 Friedman

* cited by examiner

*Primary Examiner*—Tejash Patel
(74) *Attorney, Agent, or Firm*—Laurence A. Greenberg; Werner H. Stemer; Gregory L. Mayback

(57) ABSTRACT

A method of pocketing a plastic stay in a knitted shirt collar by projecting the distal end of the stay through a side opening into the pocket and stretching the remaining pocket length over the protruding proximal end of the stay and releasing the knitted material to complete the pocketing procedure.

1 Claim, 2 Drawing Sheets

KNITTED SHIRT COLLAR WITH PLASTIC STAYS

The present invention relates to improvements in appearance-enhanced collars of shirts made of knitted construction material using plastic stays, the improvements, more particularly, facilitating the inserting of the plastic stays along the edges bounding the neck opening of the collar.

EXAMPLE OF THE PRIOR ART

It is known by common experience that while it is desired to wear an open collar shirt of knitted fabric construction material at different times because it is particularly comfortable to wear, the somewhat casual appearance afforded by it inhibits its use on occasions when a somewhat tidier appearance is desired. One reason for this is the collar which by virtue of being made of knitted fabric tends to lay irregularly and does not look neat and tidy.

Prior U.S. Pat. No. 3,286,278 for "Knitwear Articles Having Collars" issued to R. R. O'Connor on Nov. 22, 1996 directly addresses this problem and proposes as a solution inserting plastic stays in cooperating pockets strategically located at the edges of the collar which bound the front neck opening of the shirt. Using stay-embodying techniques, as disclosed in numerous prior patents, as exemplified by U.S. Pat. No. 4,286,337 for "Shape Retaining Collar Devices and Articles Of Wearing Apparel Using Same" issued to Molouf, Jr. on Sep. 1, 1981, O'Connor's knitted collar has pockets with end openings through which the plastic stays are inserted and, after which, have to be stitched closed since knitted fabric, unlike woven fabric, will not otherwise retain the pocketed stays during normal wear because of the nature of the knitted construction. The pocket-closing stitching adds to manufacturing and handling costs and prevents removal of the stays, which is desirable, before cleaning/washing the shirt at a temperature that distorts the shape of the plastic stays.

Broadly, it is an object of the present invention to provide a knitted collar with embodied plastic stays overcoming the foregoing and other shortcomings of the prior art.

More particularly, it is an object to use to advantage the use of an entry opening into the stay pockets that is closed by the stretch and recovery of the knitted construction material and thus obviates the closure stitching of the prior art, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 3:
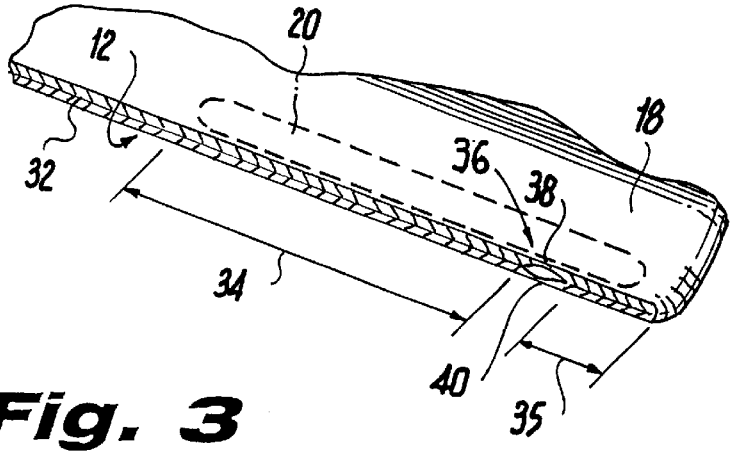
Figure 4:
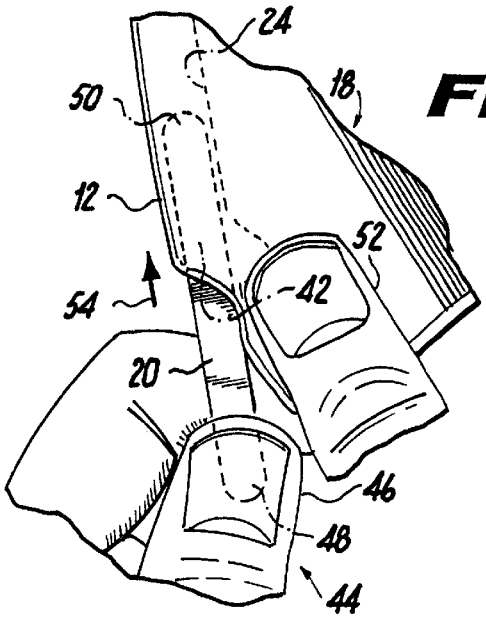
Figure 5:
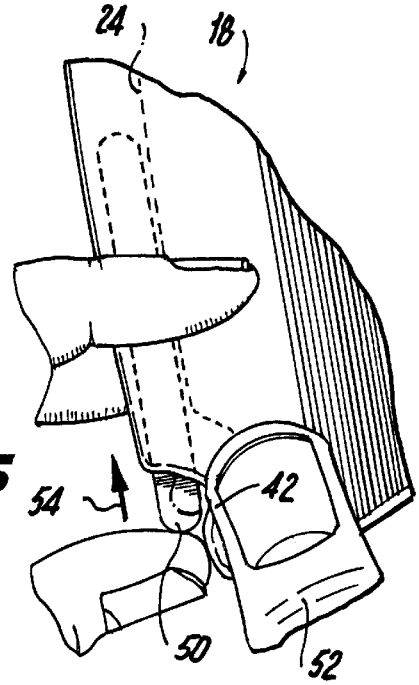
Figure 6:
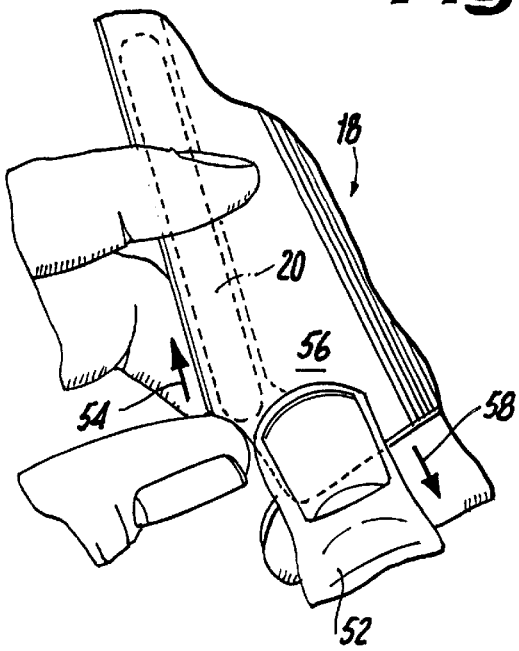
Figure 7:
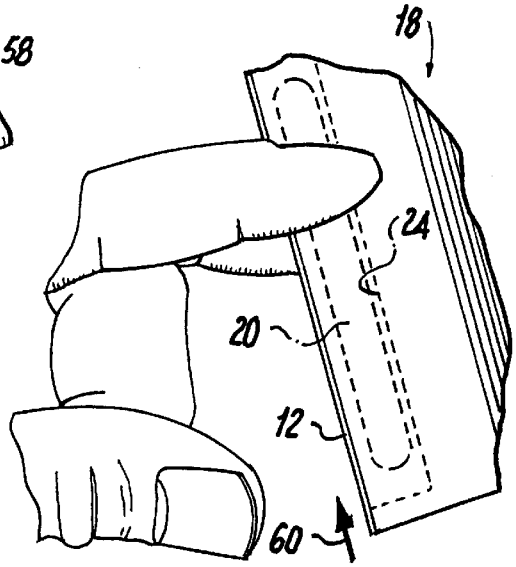

FIG. 3 is a partial perspective view, also on an enlarged scale, of the other pocketed plastic stay illustrating further details; and FIGS. 4–7, inclusive, are partial perspective views illustrating in numerical sequence, the method in accordance with the present invention in which the plastic stays are pocketed, wherein FIGS. 4 and 5 illustrate the pocketing of the distal end of the plastic stay, and FIGS. 6 and 7 the pocketing of the proximal end.

Figure 1:
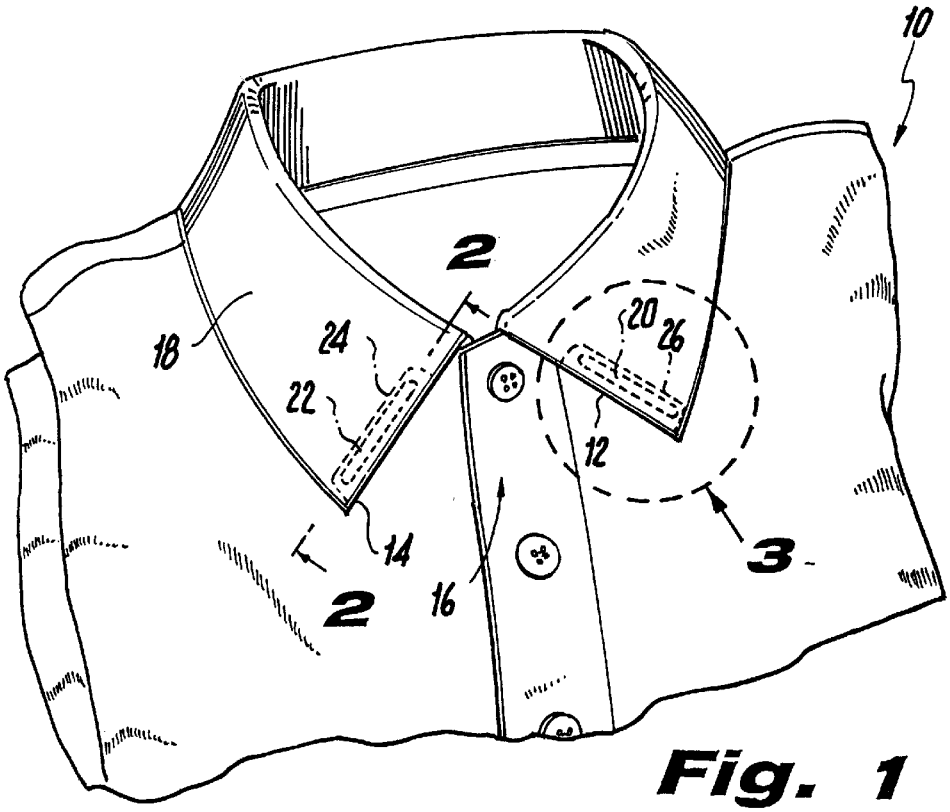
FIG. 1 is a partial perspective view of a knitted shirt with plastic stays in its collar.

Even though a knitted shirt, as generally designated 10 in FIG. 1 is typically for casual wear, an excessive curling in the edges 12 and 14 bounding the neck opening 16 of the shirt collar 18 is not entirely satisfactory, and to prevent this occurrence use is advantageously made of plastic stays, 20 on the right, and 22 on the left, inserted in cooperating pockets 26 and 24.

Figure 2:
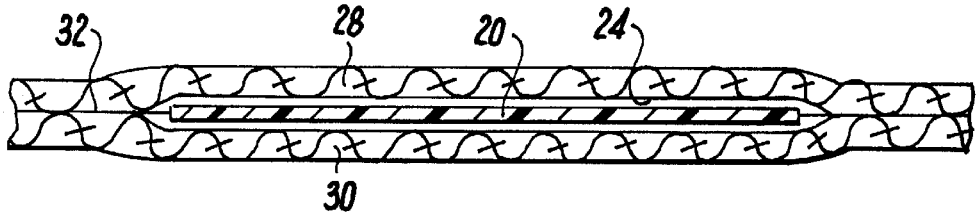
FIG. 2 is a cross-sectional view on an enlarged scale, as taken along line 2—2 of FIG. 1 illustrating details of one of the pocketed plastic stays.

In accordance with the present invention, each plastic stay 20, 22 is pocketed in its pocket 24, 26 in a noteworthy facilitated manner, as now described in connection with plastic stay 20. More particularly, as best understood from FIGS. 2, 3, in the knitting construction of the knitted collar edge 12, the top and bottom knitted plies 28 and 30 are joined along a seam 32 having a length portion 34 in continuation of the seam 32 and in parallel relation to the pocket 24, but only up to a pocket entry site 36, at which site, stitches of the seam are not employed in the knitting process, but used along a second length portion 35. Thus, between the length portions 34 and 35, the seam 32 is devoid of stitches joining the plies 28 and 30 and this results in unattached superposed edges 38 and 40 which bound an opening, generally designated 42, opening into the pocket 24 formed in a well understood manner inboard of collar edge 12.

Using the opening 42, and as best understood from FIG. 4, an installer 44 hand gripping, as at 46, the proximal end 48 of the stay 20 readily inserts the stay distal end 50 through the opening 42 and into the pocket 24, steadying the collar 18 against movement with a band grip 52.

Next, as illustrated in FIGS. 5 and 6, the full length of the stay 20 is pushed, as noted at 54 into the pocket 24 and once the stay distal end 50 clears the end of the opening 42, the steadying hand grip 52 is then used to stretch the knitted construction material 56 of the collar 18, a degree of movement 58 that is not resisted by knitting but, by comparison, would not be possible with fabric that is woven.

The plastic stay 20 is thusly fully pocketed in its cooperating pocket 24 and the hand grip 46 of FIG. 6 removed, resulting in the return of the edge 12 to its unstretched condition, a degree of movement 60 noted in FIG. 7, which is caused by the urgency of the knitting manufacturing process.

To remove the stays 20, 22, as might be desirable prior to cleaning the shirt 10, the insertion method as just described is reversed, thus using to advantage the stretchability of the knitting manufacturing process for the required handling of the stays.

While the knitted shirt collar for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of pocketing a plastic stay in a knitted shirt collar comprising the steps of:

A. knitting a shirt collar of upper and lower superposed plies of knitted construction material having left and right side edges bounding a neck opening therebetween;

B. forming in each side edge between unattached surfaces at an interface of said upper and lower plies a pocket incident to the positioning therein of a plastic stay;

C. joining with a seam of first and second separated length portions said upper and lower plies along each said side edge;

D. using as a side opening into said pocket said separation of said seam in said side edge;

E. projecting a distal end of a plastic stay through said pocket side opening and positioning a proximal end thereof in a protruding relation therefrom;

F. holding said plastic stay distal end under external finger pressure against movement while simultaneously stretching said side edge lengthwise for an extent aligning said protruding plastic stay proximal end with said pocket side opening; and G. maneuvering said proximal plastic stay end through said pocket side opening;

whereby a release of said stretched side edge results in the pocketing of said plastic stay in a condition confined against movement.

* * * * *